US012582248B2

(12) United States Patent
Chadha

(10) Patent No.: US 12,582,248 B2
(45) Date of Patent: Mar. 24, 2026

(54) FLORAL FRAMES

(71) Applicant: VENUS ET FLEUR LLC, West Hollywood, CA (US)

(72) Inventor: Seema Bansal Chadha, West Hollywood, CA (US)

(73) Assignee: VENUS ET FLEUR LLC, West Hollywood, CA (US)

( * ) Notice: Subject to any disclaimer, the term of this patent is extended or adjusted under 35 U.S.C. 154(b) by 103 days.

(21) Appl. No.: 18/744,368

(22) Filed: Jun. 14, 2024

(65) Prior Publication Data

US 2024/0415301 A1 Dec. 19, 2024

Related U.S. Application Data

(60) Provisional application No. 63/521,024, filed on Jun. 14, 2023.

(51) Int. Cl.
*A47G 1/06* (2006.01)

(52) U.S. Cl.
CPC ..... *A47G 1/0616* (2013.01)

(58) Field of Classification Search
CPC ..... A47G 1/12; A47G 1/0616; A47G 7/006; A47G 7/00; A47G 7/02; A47G 2001/0683; B44C 5/06
USPC ..... 428/34.1–36.92; 206/423, 449, 454, 455, 206/575, 578, 223, 216
See application file for complete search history.

(56) References Cited

U.S. PATENT DOCUMENTS 3,946,863 A * 3/1976 Glasband ..... B65D 77/0453 40/722
5,174,054 A * 12/1992 Politi ..... A47G 1/12 40/799
5,197,213 A * 3/1993 Borden ..... A47G 1/0616 40/748
5,218,774 A 6/1993 Mullins
5,335,433 A * 8/1994 Borden ..... A47G 1/0616 40/748

(Continued)

FOREIGN PATENT DOCUMENTS

JP 3299247 B2 * 7/2002
JP 4030175 B2 * 1/2008

(Continued)

OTHER PUBLICATIONS

House of Fleur (@houseoffleurph). Instagram post, May 13, 2023. (A photograph depicting a product comprising a central photograph surrounded by preserved roses encased in an acrylic frame) Link: https://www.instagram.com/houseoffleurph/p/CsK9Fmjrd-p/.

(Continued)

*Primary Examiner* — Cassandra Davis
(74) *Attorney, Agent, or Firm* — HOLLAND & HART LLP

(57) ABSTRACT

Various aspects of this disclosure relate to a frame configured to display a two-dimensional image, such as a photograph, that is framed by three-dimensional subject matter, such as rose flowers. The frame generally protects delicate three-dimensional subject matter during storage, shipping, and use. When the three-dimensional subject matter consists of flowers, then the frame can retain aromatic molecules, for example, to preserve the scent of the flowers.

17 Claims, 5 Drawing Sheets

(56) References Cited

U.S. PATENT DOCUMENTS

| | | | | |
|---|---|---|---|---|
| 5,361,522 | A | 11/1994 | Green | |
| 6,415,739 | B1 * | 7/2002 | Orendorff | A01K 63/003 40/406 |
| 8,365,448 | B2 | 2/2013 | Gorham, Jr. | |
| 8,875,430 | B2 * | 11/2014 | Leboff | A47G 1/12 40/722 |

FOREIGN PATENT DOCUMENTS

| | | | | |
|---|---|---|---|---|
| JP | 3198390 | U * | 7/2015 | |
| KR | 20130134251 | A * | 12/2013 | A01G 5/04 |
| KR | 101638399 | B1 * | 7/2016 | A47G 7/04 |

OTHER PUBLICATIONS

Eternal Fleur. Instagram Post. May 1, 2019. (The Instagram post content displays an acrylic frame encircled by preserved roses, as offered by a company specializing in preserved roses.) Link: https://www.instagram.com/p/Bw7CAE3HBnH/?hl=en.

CM Lux Decor (@cmlux.decor), Instagram Post, Feb. 20, 2023 Link:. https://www.instagram.com/reel/Co7ZeeZtUTI/?igsh=NW00c2JsZWthMmU4 Link: https://www.instagram.com/cmlux.decor/reel/Co42BPIOUyU/.

O'Connor Mortuary. Internet Archive Wayback Machine captures (dating back to Aug. 2021). (The archived webpages display a product featuring flowers arranged around a central photograph.) Link: https://web.archive.org/web/20220925090320/https://www.oconnormortuary.com/product/little-touch-of-iris-photo-frame/.

Empyrean the Collective Internet Archive Wayback Machine capture: Jun. 14, 2022. Link: https://web.archive.org/web/20220614013431/https://www.empyreanthecollective.com/products/personalised-flower-polaroid-frame (The screenshot shows a preserved flower frame featuring an acrylic case surrounded by preserved roses with a central space for inserting a 2D object.).

* cited by examiner

FLORAL FRAMES

CROSS-REFERENCE TO RELATED APPLICATIONS

This application claims the benefit of U.S. Provisional Patent Application No. 63/521,024, filed Jun. 14, 2023, the disclosure of which is incorporated, in its entirety, by this reference.

BACKGROUND

Frames for artwork have been known for thousands of years. Such frames vary from the very simple to the very ornate. Some frames may include depictions of living things, including flowers, for example, as carvings or moldings. Arrangements of real flowers are also presented as artwork, and their presentation and preservation is challenging as the flowers age. The use of real flowers in a frame is therefore generally limited to an event or a short duration of time ranging from hours to weeks. Flowers may nevertheless be preserved, for example, in resin, but resins generally alter the appearance of flowers and prevent release of favorable aromatics. Innovative methods to preserve floral frames would allow differentiated commercial products.

BRIEF SUMMARY

Various aspects of this disclosure relate to floral frames that allow the preservation of flowers on a timescale of months-to-years. Such floral frames advantageously also protect flowers of a frame during shipping and storage.

The floral frames of this disclosure generally comprise an inner display for a two-dimensional image such as a picture or artwork and an outer display for a three-dimensional arrangement of flowers. The inner display may be set back relative to the front of the three-dimensional arrangement, for example, such that flower petals of a three-dimensional arrangement of flowers frame the two-dimensional image. The set-back position is chosen based on aesthetics, and a distance of 3 to 4 centimeters, for example, is generally aesthetically optimal for standard roses that face the same direction as the two-dimensional image when the roses lack a stem or include no more than a few millimeters of stem.

The size of a floral frame depends in part upon the desired size of a two-dimensional image and the desired size of a three-dimensional arrangement of flowers. An aesthetically-optimal size for a frame that includes a single outer row of standard roses that circumscribe a 13-by-18-centimeter (5-by-7 inch) two-dimensional image, for example, is 245 millimeters wide (9.5 inches), 294 millimeters high (11.6 inches), and 68 millimeters deep (2.68 inches). This size allows for an aesthetically-pleasing frame of 5 by 6 roses that surround the image (18 total roses). This disclosure nevertheless contemplates other frame sizes, image sizes, flower types and sizes, and arrangements of flowers, and the scope of any claim that matures from this disclosure shall be limited by the language of the claim without regard to other features set forth in this disclosure such as the aesthetically-optimal size disclosed in this paragraph.

The frames of this disclosure may include a lid cover. The lid cover protects the flowers from contacting other objects, which can protect the flowers during shipping, storing, and handling. The lid cover also advantageously preserves scents of the flowers, for example, during shipping, storage, and other periods of non-use. The lid cover may be removed during normal use of the frame, for example, to release scents during periods of use and/or reduce glare and reflections.

DETAILED DESCRIPTION

Figure 1A:
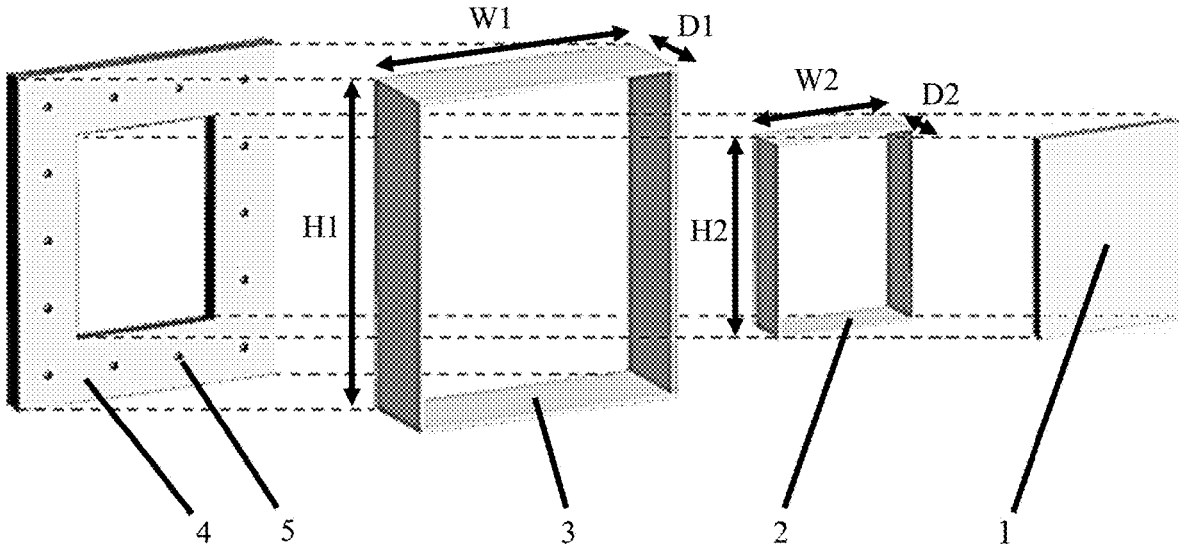
FIG. 1A is an exploded, isometric representation of a front plate 1, inner wall 2, outer wall 3, and back plate 4 of a frame according to the present disclosure.
Figure 1B:
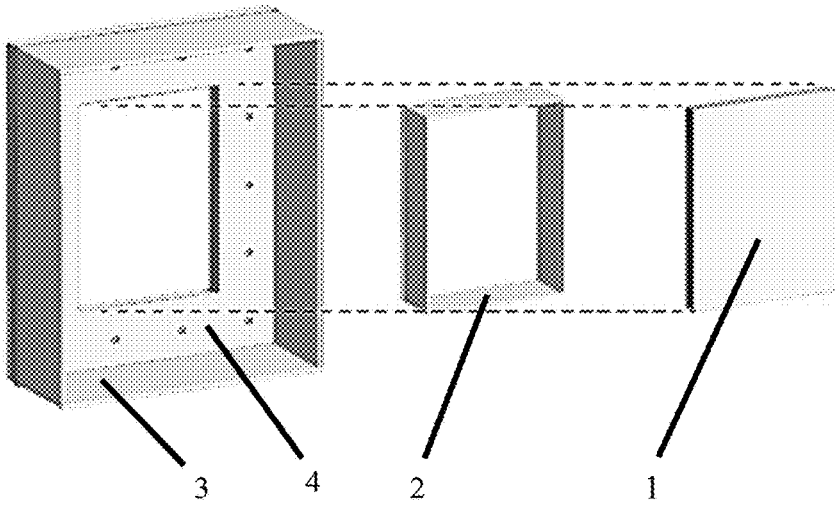
FIG. 1B is a partially-exploded, isometric representation of the frame depicted in FIG. 1A, in which the outer wall 3 is mounted to the back plate 4.
Figure 1C:
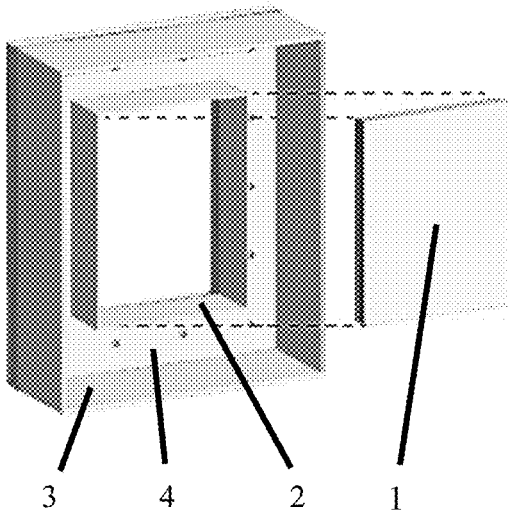
FIG. 1C is a partially-exploded, isometric representation of the frame depicted in FIGS. 1A & 1B, in which the inner wall 2 and outer wall 3 are mounted to the back plate 4.

Various aspects of this disclosure relate to a frame that comprises a central two-dimensional space for a two-dimensional image and a surrounding three-dimensional space that circumscribes the two-dimensional image. The three-dimensional space allows the display of three-dimensional subject matter, such as an arrangement of flowers, around the two-dimensional image.

In all embodiments, a frame comprises a front plate 1, an inner wall 2, an outer wall 3, and a back plate 4. FIGS. 1A-1E depict the assembly of a rectangular frame of this disclosure. This disclosure nevertheless encompasses other shapes including oval frames, circular frames, square frames, and heart-shaped frames.

A front plate 1 is generally mounted on the inner wall 2. This disclosure generally allows exchange of two-dimensional images through the back plate 4 of a frame, which allows the front plate 1 to be permanently affixed to the inner wall 2, and allows for clean lines between the front plate 1 and the inner wall 2. Allowing exchange of two-dimensional images through the back plate 4 also advantageously reduces the risk that the exchange of two-dimensional images will disturb three-dimensional subject matter, such as an arrangement of flowers, during an exchange through the front plate 1. The front plate 1 may therefore be permanently affixed to the inner wall 2 such as with an adhesive applied to the edges of the front plate 1.

The front plate 1 is generally transparent to visible light such that a two-dimensional image behind the front plate 1 is visible through the front plate 1. Suitable materials for the front plate 1 include glass and clear plastics such as poly (methyl methacrylate), which is commonly called acrylic and known by the brand name PLEXIGLAS®.

The inner wall 2 and the outer wall 3 are generally mounted on the back plate 4. Together, the inner wall 2, the outer wall 3, and the back plate 4 are configured to protect three-dimensional subject matter such as flowers, and thus, the inner wall 2 and the outer wall 3 are typically mounted on the back plate 4 in a fashion that preserves the structural integrity of the configuration between the inner wall 2, the outer wall 3, and the back plate 4 during shipping, storage, and handling. The precise nature of the mounting is not limiting and includes adhesives as well as mechanical fastening mechanisms such as rivets either independently or in combination.

The outer wall 3 is optionally transparent to visible light such that three-dimensional subject matter is visible through the outer wall 3. Suitable materials for the outer wall 3 include acrylic.

The composition of the inner wall 2 and the back plate 4 are limited primarily by their structural requirements. The inner wall 2 requires suitable durability and rigidness to support its own weight and to attach to the back plate 4. The back plate 4 requires suitable durability and rigidness to support the weight of the frame and to support three-dimensional subject matter that is typically mounted to the back plate 4 when a frame is sold to an end user in a retail sale. Suitable materials for the inner wall 2 and the back plate 4 include plastics (including acrylic, polyvinyl chloride, polyethylene, polyethylene terephthalate, polypropylene, and polystyrene) and metals (such as aluminum) although other materials may alternatively be used including wood, particle board, and other pressed and composite boards. The precise composition of the inner wall 2 and the back plate 4 is generally driven by manufacturing costs and aesthetics.

The back plate 4 optionally comprises dimples 5 or other markings that identify attachment points for three-dimensional subject matter and optionally provide favorable structure for attachment. The back plate 4 may optionally comprise, for example, threaded holes for attachment of three-dimensional subject matter with bolts. Dimples 5 and other patterned surfaces are nevertheless sufficient for most applications in which three-dimensional subject matter is attached to the back plate 4 with an adhesive.

FIGS. 1A-1E depict a rectangular frame, in which the outer wall 3 has a height H1, width W1, and depth D1, and the inner wall 2 has a height H2, width W2, and depth D2. Other geometries and shapes are contemplated within the scope of the present disclosure.

Figure 1D:
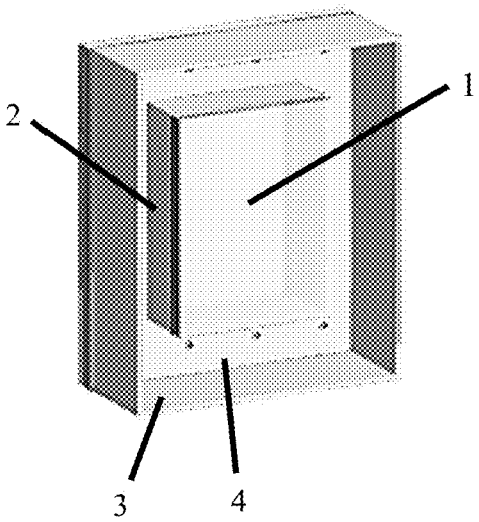
FIG. 1D is a partially-assembled, isometric representation of the frame depicted in FIGS. 1A-1C, in which the inner wall 2 and outer wall 3 are mounted to the back plate 4, and the front plate 1 is mounted to the inner wall 2.
Figure 1E:
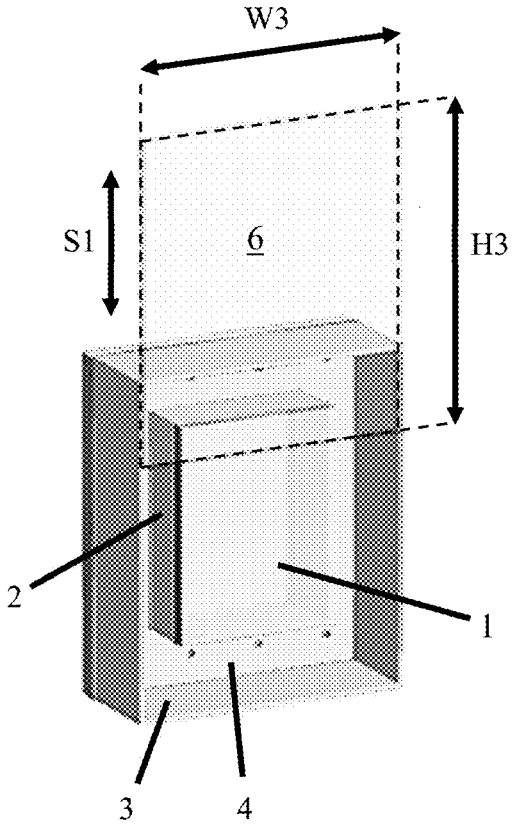
FIG. 1E is a partially-assembled, isometric representation of the frame depicted in FIGS. 1A-1D, in which the inner wall 2 and outer wall 3 are mounted to the back plate 4, the front plate 1 is mounted to the inner wall 2, and a lid cover 6 slidably engages the outer wall.

FIGS. 1D and 1E depict an assembled front plate 1, inner wall 2, back plate 4, and outer wall 3. FIG. 1E also depicts a lid cover 6, which slidably engages the outer wall 3 in a first direction S1. The lid cover 6 has partially-engaged the outer wall 3 as depicted in FIG. 1E. The lid cover 6 has a height H3 and width W3 that is approximately equal to the height H1 and width W1 of the outer wall 3 such that when the lid cover 6 fully engages the outer wall 3, then the lid cover 6 seals a three-dimensional space between the lid cover 6 and the back plate 4, between the outer wall 3 and the inner wall 2, and between the lid cover 6 and the front plate 1 to inhibit fluid communication between the three-dimensional space and air that surrounds the frame.

Other methods for attaching the lid cover 6 to the outer wall 3 are viable and include hinges, adhesives, clasps, screws, hook-and-loop fasteners, and others. Slidable attachment nevertheless allows an appropriate balance between a robust structure, hermetic seal, and clean lines. The lid cover 6 may also alternatively slidably engage the outer wall 3 in a direction other than the first direction S1 such as a direction parallel to its width W3 and perpendicular to the first direction S1.

Figure 2A:
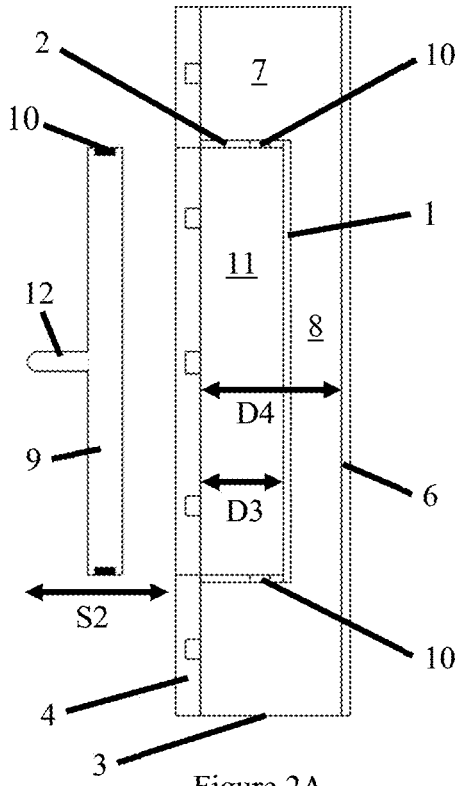
FIG. 2A is partially-assembled side representation of a frame and a removable back insert 9, in which the lid cover 6 of the frame fully engages the outer wall 3 of the frame.
Figure 2B:
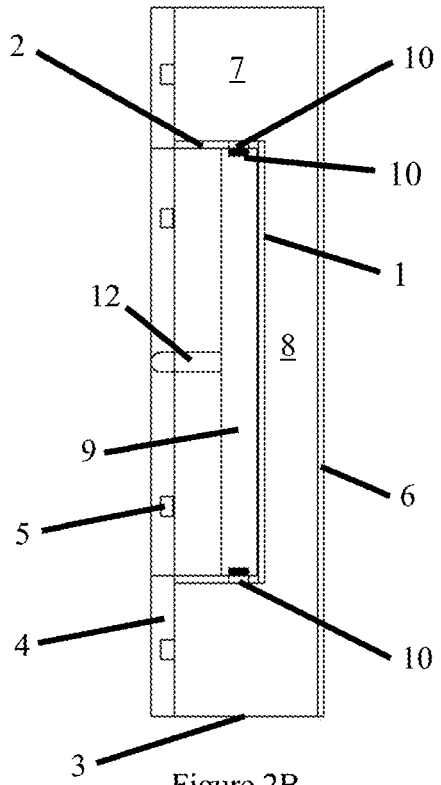
FIG. 2B is fully-assembled side representation of the frame depicted in FIG. 2A, in which magnetic fasteners 10 reversibly couple the removable back insert 9 to the inner wall 2 such that the removable back insert 9 fully engages the inner wall 2.

FIGS. 2A and 2B depict a side view of the frame depicted in FIGS. 1A-1E. The front plate 1 is mounted to the inner wall 2. The inner wall 2 and outer wall 3 are mounted to the back plate 4. The lid cover 6 is depicted as fully engaging the outer wall 3 to define a three-dimensional space 7. The three-dimensional space 7 includes a gap 8 between the lid cover 6 and front plate 1. The gap 8 in the three-dimensional space 7 allows, for example, petals of flowers (not shown) disposed within the three-dimensional space 7 to frame and partially overlap a two-dimensional image (not shown) disposed behind the front plate 1.

FIGS. 2A and 2B also each depict a removable back insert 9. One or both of the removable back insert 9 and the inner wall 2 typically comprise fasteners 10 that reversibly couple the removable back insert 9 to the inner wall 2 when the removable back insert 9 fully engages the inner wall 2. As depicted in FIGS. 2A and 2B, the removable back insert 9 and the inner wall 2 each comprise two magnetic fasteners 10.

The removable back insert 9 typically slidably engages the inner wall 2 in a second direction S2. Unlike the lid cover 6, which typically slidably engages the outer wall 3 via grooves or tracks (not shown) in the outer wall 3, the removable back insert 9 slidably engages the inner wall 2 because the removable back insert 9 is shaped to fit a void 11 in the inner wall 2.

As depicted in FIGS. 2A and 2B, a front-facing surface of the removable back inert 9 must be oriented approximately parallel to the front plate 1 and perpendicular to sides of the inner wall 2 to slidably engage the inner wall 2 due to the thickness of the removable back insert 9, which thickness allows the removable back insert 9 to accommodate the magnetic fasteners 10. In this configuration, the removable back insert 9 slidably engages the inner wall 2 in a second direction S2, which is approximately perpendicular to the first direction S1, in which the lid cover 6 slidably engages the outer wall 3. In other embodiments, the relative thinness of the removable back insert 9 allows the removable back insert 9 to slidably engage the inner wall 2 at many different angles; the removable back insert 9 nevertheless slidably engages the inner wall 2 in the second direction S2, which is approximately perpendicular to the first direction S1. The removable back insert 9 is ultimately oriented parallel to the front plate 1 when the removable back insert 9 fully engages the inner wall 2 as shown in FIG. 2B.

"First direction" and "second direction" are identified relative to order of appearance in the figures and specification. The terms are nevertheless switched in various claims based on order of appearance the claims; the adjectives "first" and "second" shall have no meaning in relation to the noun "direction" except to differentiate two different directions.

The depth D3 of the inner wall 2, which is depicted in FIG. 2A, is generally at least 20 percent and up to 95 percent of the depth D4 of the three-dimensional space 7 such that the front plate 1 is suspended in the three-dimensional space 7. A two-dimensional image between the front plate 1 and the removable back insert 9, is therefore also suspended in the three-dimensional space 7, when the removable back insert 9 fully engages the inner wall 2 to display the two-dimensional image. Such positioning favorably displays the two-dimensional image relative to three-dimensional subject matter in the three-dimensional space 7.

Figure 3:
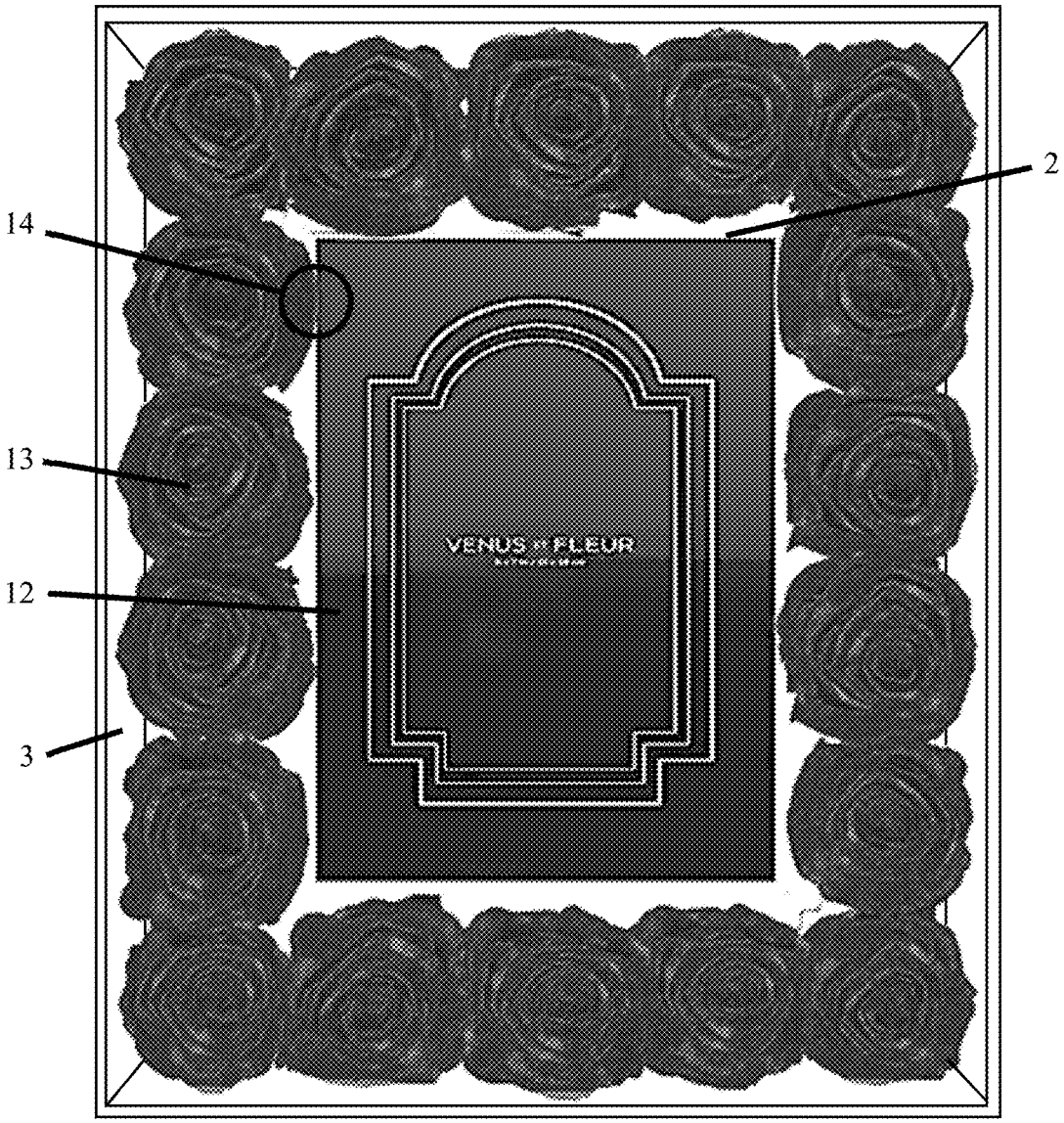
FIG. 3 is a fully-assembled front representation of a frame of the present disclosure including 18 rose flowers 13, which are visible through the lid cover (transparent), and a two-dimensional image 12, which is visible through the lid cover (transparent) and the front plate (transparent).

FIG. 3 depicts a frame that includes a two-dimensional image 12, which is a 13-by-18-centimeter (5-by-7 inch) product insert, and three-dimensional subject matter 13, which consists of 18 rose flowers. The frame of FIG. 3 is configured to display a 13-by-18-centimeter (5-by-7 inch) two-dimensional image. The 18 rose flowers 13 frame the two-dimensional image 12. The inner wall 2 has a depth D3 that is less than the depth D4 of the three-dimensional space such that petals of the rose flowers extend into the gap 8 between the lid cover (transparent; not visible) and front plate (transparent; not visible) and such that the petals frame the rose flowers 13 partially obscure 14 edges of the two-dimensional image 12.

The preceding detailed description describes the embodiments of the Figures, and the following detailed description describes features of the inventive subject matter generally with language selected to define the full scope of the invention. The scope of any claim that matures from this disclosure shall be limited by the language of the claim without regard to other features set forth in the preceding and following detailed description.

Various aspects of this disclosure relate to a frame, comprising a front plate, an inner wall, an outer wall, a back plate, a lid cover, a removable back insert, and flowers.

In some embodiments, the front plate is transparent. In some specific embodiments, the front plate is transparent to visible light.

In some embodiments, the front plate is mounted to the inner wall. In some specific embodiments, the front plate is mounted to the inner wall with an adhesive.

In some embodiments, the removable back insert engages the inner wall in a first direction. In some specific embodiments, the removable back insert slidably engages the inner wall in a first direction. In some very specific embodiments, the removable back insert slidably engages the inner wall in a first direction, wherein, when the removable back insert fully engages the inner wall, then the removable back insert, the inner wall, and the front plate define a two-dimensional space in the frame between the removable back insert and the front plate and between sides of the inner wall.

In some embodiments, a two-dimensional image is positioned in the two-dimensional space. In some specific embodiments, the two-dimensional image is positioned in the two-dimensional space such that the two-dimensional image fills a portion or all of the two-dimensional space, the two-dimensional image faces the front plate, and the two-dimensional image is visible through the front plate.

In some embodiments, the two-dimensional image is a photograph, artwork, advertisement, or product insert.

In some embodiments, the inner wall, the outer wall, and the flowers are mounted to the back plate.

In some embodiments, the lid cover slidably engages the outer wall in a second direction. In some specific embodiments, the lid cover slidably engages the outer wall in a second direction, wherein, when the lid cover fully engages the outer wall, then (a) the lid cover, the outer wall, the inner wall, the front plate, and the back plate define a three-dimensional space in the frame between the lid cover and the back plate, between the outer wall and the inner wall, and between the lid cover and the front plate, (b) the flowers extend from the outer wall into the three-dimensional space, and (c) the lid cover protects the flowers.

In some embodiments, the lid cover is transparent. In some specific embodiments, the lid cover is transparent to visible light. In some specific embodiments, the lid cover is transparent such that the flowers are visible through the lid cover.

In some embodiments, the outer wall is transparent. In some specific embodiments, the outer wall is transparent to visible light. In some specific embodiments, the outer wall is transparent such that the flowers are visible through the outer wall.

In some embodiments, the lid cover and the outer wall are transparent such that the flowers are visible through the lid cover and the outer wall.

In some embodiments, the flowers frame the two-dimensional image.

In some embodiments, the first direction (of the removable back insert) is perpendicular to the front plate and the second direction (of the lid cover), and the second direction is parallel to the front plate.

In some embodiments, one or both of the removable back insert and the inner wall comprise fasteners. In some specific embodiments, one or both of the removable back insert and the inner wall comprise magnetic fasteners. In some very specific embodiments, one or both of the removable back insert and the inner wall comprise magnetic fasteners, wherein the magnetic fasteners reversibly couple the removable back insert to the inner wall when the removable back insert fully engages the inner wall.

In some embodiments, the magnetic fasteners apply force that fixes the position of the two-dimensional image in the two-dimensional space.

In some embodiments, the removable back insert comprises a handle 15. In some specific embodiments, the removable back insert comprises a handle configured to remove the removable back insert from the inner wall. In some very specific embodiments, the removable back insert comprises a handle configured to remove the removable back insert from the inner wall and thereby decouple the magnetic fasteners.

In some embodiments, the back plate comprises an opening that is sized to allow removal of the removable back insert from the inner wall through the opening.

Various aspects of this disclosure relate to a method of using a frame described anywhere in this disclosure, comprising removing the lid cover.

In some embodiments, the frame comprises aromatic molecules. In some specific embodiments, the frame comprises aromatic molecules, and removing the lid cover allows a portion of the aromatic molecules to escape the three-dimensional space. In some very specific embodiments, the frame comprises flowers that comprise aromatic molecules, and removing the lid cover allows a portion of the aromatic molecules to escape the three-dimensional space.

In some embodiments, the lid cover slidably engages the outer wall in a second direction, wherein, when the lid cover fully engages the outer wall, then (a) the lid cover, the outer wall, the inner wall, the front plate, and the back plate define a three-dimensional space in the frame between the lid cover and the back plate, between the outer wall and the inner wall, and between the lid cover and the front plate, (b) the flowers extend from the outer wall into the three-dimensional space, (c) the lid cover protects the flowers, (d) the aromatic molecules volatize from the flowers into the three-dimensional space, and (e) the lid cover inhibits the aromatic molecules from escaping the three-dimensional space.

In some embodiments, the method comprises photographing or videotaping the frame after removing the lid cover. In some specific embodiments, the method comprises photographing or videotaping the frame after removing the lid cover, wherein removing the lid cover prevents the photographing or videotaping from recording reflections of the lid cover.

Various aspects of this disclosure relate to a frame, comprising a front plate, an inner wall, an outer wall, a back plate, a lid cover, and a removable back insert.

In some embodiments, the front plate is transparent and mounted to the inner wall.

In some embodiments, the inner wall is mounted to the back plate.

In some embodiments, the outer wall is mounted to the back plate.

In some embodiments, the lid cover is transparent and slidably engages the outer wall in a first direction. In some specific embodiments, the lid cover is transparent and slidably engages the outer wall in a first direction, wherein, when the lid cover fully engages the outer wall, then (a) the lid cover, the outer wall, the inner wall, and the back plate define a three-dimensional space in the frame between the lid cover and the back plate and between the outer wall and the inner wall, and (b) the lid cover inhibits fluid communication between the three-dimensional space and air that surrounds the frame.

In some embodiments, the removable back insert slidably engages the inner wall in a second direction. In some specific embodiments, the removable back insert slidably engages the inner wall in a second direction, wherein, when the removable back insert fully engages the inner wall, then the removable back insert, the inner wall, and the front plate define a two-dimensional space in the frame between the removable back insert and the front plate and between sides of the inner wall.

In some embodiments, the first direction (of the lid cover) is parallel to the front plate and perpendicular to the second direction (of the removable back insert).

In some embodiments, the second direction (of the removable back insert) is perpendicular to the front plate and through the inner wall.

In some embodiments, one or both of the removable back insert and the inner wall comprise fasteners, wherein the fasteners reversibly couple the removable back insert to the inner wall when the removable back insert fully engages the inner wall. In some specific embodiments, the fasteners are magnetic fasteners. In some embodiments, the fastener is a tension-based fastener such as a spring clip or a spring-loaded ball catch.

In some embodiments, the removable back insert comprises a handle. In some specific embodiments, the removable back insert comprises a handle configured to remove the removable back insert from the inner wall and thereby decouple the fasteners.

In some embodiments, the back plate comprises an opening that is sized to allow removal of the removable back insert from the inner wall through the opening.

In some embodiments, the frame comprises flowers. In some specific embodiments, the flowers are rose flowers.

In some embodiments, each flower is mounted to the back plate and positioned in the three-dimensional space such that each flower faces the lid cover and each flower is visible through the lid cover.

In some embodiments, the outer wall is transparent. In some specific embodiments, the outer wall is transparent to visible light.

In some embodiments, the frame comprises a two-dimensional image.

In some embodiments, the two-dimensional image is a photograph, artwork, advertisement, or product insert. In some specific embodiments, the two-dimensional image is a photograph. In some specific embodiments, the two-dimensional image is a product insert. In some very specific embodiments, the two-dimensional image is a product insert that depicts the brand name of the frame. In some very specific embodiments, the two-dimensional image is a product insert that sets forth maximum dimensions for two-dimensional images that the two-dimensional space will accommodate (for example, such as 13-by-18-centimeters or 5-by-7 inches).

In some embodiments, the two-dimensional image is positioned in the two-dimensional space such that the two-dimensional image fills a portion or all of the two-dimensional space, the two-dimensional image faces the front plate, and the two-dimensional image is visible through the front plate.

In some embodiments, the fasteners are magnetic fasteners. In some specific embodiments, the fasteners are magnetic fasteners, and the magnetic fasteners apply force that fixes the position of the two-dimensional image in the two-dimensional space.

In some embodiments, the frame comprises flowers, wherein: the lid cover fully engages the outer wall; each flower is mounted to the back plate and positioned in the three-dimensional space such that each flower faces the lid cover and each flower is visible through the lid cover; the outer wall is transparent such that sides of the flowers are visible through the outer wall; the three-dimensional space has a depth measured between the lid cover and the back plate; the inner wall has a depth measured between the front plate and the back plate; the depth of the inner wall is at least 20 percent and up to 95 percent of the depth of the three-dimensional space such that the front plate is suspended in the three-dimensional space; the three-dimensional space comprises a gap between the front plate and the lid cover; the front plate defines a plane that intersects the outer wall; the outer wall, the lid cover, and the plane define a rectangular cuboid space between the lid cover and the plane and between sides of the outer wall; the rectangular cuboid space comprises the gap; the three-dimensional space comprises the rectangular cuboid space; and the flowers extend into the rectangular cuboid space. In some specific embodiments, the frame comprises flowers and a two-dimensional image, wherein: the lid cover fully engages the outer wall; each flower is mounted to the back plate and positioned in the three-dimensional space such that each flower faces the lid cover and each flower is visible through the lid cover; the outer wall is transparent such that sides of the flowers are visible through the outer wall; the two-dimensional image is positioned in the two-dimensional space such that the two-dimensional image fills a portion or all of the two-dimensional space; the three-dimensional space has a depth measured between the lid cover and the back plate; the inner wall has a depth measured between the front plate and the back plate; the depth of the inner wall is at least 20 percent and up to 95 percent of the depth of the three-dimensional space such that the front plate is suspended in the three-dimensional space; the three-dimensional space comprises a gap between the front plate and the lid cover; the front plate defines a plane that intersects the outer wall; the outer wall, the lid cover, and the plane define a rectangular cuboid space between the lid cover and the plane and between sides of the outer wall; the rectangular cuboid space comprises the gap; the three-dimensional space comprises the rectangular cuboid space; and the flowers extend into the rectangular cuboid space such that the flowers extend beyond the two-dimensional image in the second direction (of the removable back insert).

In some embodiments, petals of the flowers extend into the gap. In some specific embodiments, petals of the flowers extend into the gap such that the petals frame the two-dimensional image and partially obscure edges of the two-dimensional image.

In some embodiments, the frame is effective at protecting flowers within the three-dimensional space during shipping, storage, and handling of the frame.

In some embodiments, the frame comprises aromatic molecules, wherein: the lid cover fully engages the outer wall; the aromatic molecules are disposed in the three-dimensional space; and the lid cover inhibits the aromatic molecules from escaping the three-dimensional space. In some specific embodiments, the frame comprises aromatic molecules, wherein: the lid cover fully engages the outer wall; the aromatic molecules are disposed in the three-dimensional space; and the lid cover is effective at retaining at least 50 percent of the aromatic molecules in the three-dimensional space for a period of time of at least 6 months. In some very specific embodiments, the frame comprises flowers and aromatic molecules, wherein: the lid cover fully engages the outer wall; the aromatic molecules volatize from the flowers into the three-dimensional space; and the lid cover is effective at retaining at least 50 percent of the aromatic molecules in the three-dimensional space for a period of time of at least 6 months.

In some embodiments, the lid cover hermetically seals the three-dimensional space when the lid cover fully engages the outer wall.

In some embodiments, the lid cover inhibits oxygen in air that surrounds the frame from entering the three-dimensional space. In some specific embodiments, the frame preserves flowers disposed within the three-dimensional space by inhibiting oxygen in air that surrounds the frame from entering the three-dimensional space. In some very specific embodiments, the frame inhibits oxidation of flowers disposed within the three-dimensional space by inhibiting oxygen in air that surrounds the frame from entering the three-dimensional space.

In some embodiments, when the lid cover fully engages the outer wall, then the three-dimensional space has a depth measured between the lid cover and the back plate; the inner wall has a depth measured between the front plate and the back plate; and the depth of the inner wall is at least 20 percent and up to 95 percent of the depth of the three-dimensional space such that the front plate is suspended in the three-dimensional space.

In some embodiments, the depth of the inner wall is at least 30 percent and up to 90 percent of the depth of the three-dimensional space such that the front plate is suspended in the three-dimensional space. In some specific embodiments, the depth of the inner wall is at least 40 percent and up to 85 percent of the depth of the three-dimensional space. In some very specific embodiments, the depth of the inner wall is at least 50 percent and up to 80 percent of the depth of the three-dimensional space.

In some embodiments, the front plate defines a plane that intersects the outer wall; the outer wall, the lid cover, and the plane define a rectangular cuboid space between the lid cover and the plane and between sides of the outer wall; and the three-dimensional space comprises the rectangular cuboid space.

In some embodiments, the two-dimensional space has a thickness measured between the front plate and the removable back insert, which thickness is no greater than 5 millimeters; the depth of the inner wall is at least 5 times greater than the thickness of the two-dimensional space and at least 2 centimeters; and the depth of the three-dimensional space is at least 10 times greater than the thickness of the two-dimensional space and at least 4 centimeters.

In some embodiments, the thickness of the two-dimensional space is no greater than 2 millimeters. In some specific embodiments, the thickness of the two-dimensional space is no greater than 1 millimeter. In some very specific embodiments, the thickness of the two-dimensional space is no greater than 500 micrometers.

In some embodiments, the frame comprises 18 rose flowers; the lid cover fully engages the outer wall; the 18 rose flowers are arranged in the three-dimensional space in a 5-rose-flower by 6-rose-flower rectangle; each rose flower is mounted to the back plate and positioned in the three-dimensional space such that each rose flower faces the lid cover and each rose flower is visible through the lid cover; the outer wall is transparent such that sides of the rose flowers are visible through the outer wall; the fasteners are magnetic fasteners; the three-dimensional space has a depth measured between the lid cover and the back plate; the inner wall has a depth measured between the front plate and the back plate; the depth of the inner wall is at least 30 percent and up to 90 percent of the depth of the three-dimensional space such that the front plate is suspended in the three-dimensional space; the three-dimensional space comprises a gap between the front plate and the lid cover; and petals of the rose flowers extend into the gap. In some specific embodiments, the frame comprises 18 rose flowers and a 13-by-18-centimeter two-dimensional image; the lid cover fully engages the outer wall; the 18 rose flowers are arranged in the three-dimensional space in a 5-rose-flower by 6-rose-flower rectangle; each rose flower is mounted to the back plate and positioned in the three-dimensional space such that each rose flower faces the lid cover and each rose flower is visible through the lid cover; the outer wall is transparent such that sides of the rose flowers are visible through the outer wall; the two-dimensional image is positioned in the two-dimensional space such that the two-dimensional image fills a portion or all of the two-dimensional space; the fasteners are magnetic fasteners; the magnetic fasteners apply force that fixes the position of the two-dimensional image in the two-dimensional space; the three-dimensional space has a depth measured between the lid cover and the back plate; the inner wall has a depth measured between the front plate and the back plate; the depth of the inner wall is at least 30 percent and up to 90 percent of the depth of the three-dimensional space such that the front plate is suspended in the three-dimensional space; the three-dimensional space comprises a gap between the front plate and the lid cover; and petals of the rose flowers extend into the gap such that the petals frame the two-dimensional image and partially obscure edges of the two-dimensional image.

In some embodiments, the fasteners are magnetic fasteners; the magnetic fasteners comprise four magnets; the inner wall comprises two of the four magnets; the removable back insert comprises two of the four magnets; and the two magnets of the inner wall approximately align with the two magnets of the removable back insert when the removable back insert fully engages the inner wall to apply force between the front plate and the removable back insert.

In some embodiments, the inner wall has a height, width, and depth.

In some embodiments, the height of the inner wall is at least 10 centimeters. In some specific embodiments, the height of the inner wall is at least 16 centimeters and up to 21 centimeters. In some very specific embodiments, the height of the inner wall is at least 17 centimeters and up to 18.5 centimeters.

In some embodiments, the width of the inner wall is at least 8 centimeters. In some specific embodiments, the width of the inner wall is at least 12 centimeters and up to 15 centimeters. In some very specific embodiments, the width of the inner wall is at least 12 centimeters and up to 13.5 centimeters.

In some embodiments, the depth of the inner wall is at least 2 centimeters. In some specific embodiments, the depth of the inner wall is at least 3 centimeters and up to 4 centimeters. In some very specific embodiments, the depth of the inner wall is at least 3 centimeters and up to 3.5 centimeters.

In some embodiments, the outer wall has a height, width, and depth.

In some embodiments, the height of the outer wall is at least 18 centimeters. In some embodiments, the height of the outer wall is at least 27 centimeters and up to 34 centimeters. In some specific embodiments, the height of the outer wall is at least 28.5 centimeters and up to 30.5 centimeters.

In some embodiments, the width of the outer wall is at least 15 centimeters. In some specific embodiments, the width of the outer wall is at least 22 centimeters and up to 28 centimeters. In some very specific embodiments, the width of the outer wall is at least 23.5 centimeters and up to 25.5 centimeters.

In some embodiments, the depth of the outer wall is at least 3 centimeters. In some specific embodiments, the depth of the outer wall is at least 5 centimeters and up to 9 centimeters. In some very specific embodiments, the depth of the outer wall is at least 6 centimeters and up to 8 centimeters.

In some embodiments, the height of the outer wall is greater than the height of the inner wall.

In some embodiments, the width of the outer wall is greater than the width of the inner wall.

In some embodiments, the back plate has a height of at least 18 centimeters. In some specific embodiments, the back plate has a height of at least 27 centimeters and up to 34 centimeters. In some very specific embodiments, the back plate has a height of at least 28.5 centimeters and up to 30.5 centimeters.

In some embodiments, the back plate has a height that varies from the height of the outer wall by up to 1 centimeter. In some specific embodiments, the back plate has a height that varies from the height of the outer wall by up to 5 millimeters. In some very specific embodiments, the back plate has a height that varies from the height of the outer wall by up to 2 millimeters.

In some embodiments, the back plate has a width of at least 15 centimeters. In some specific embodiments, the back plate has a width of at least 22 centimeters and up to 28 centimeters. In some very specific embodiments, the back plate has a width of at least 23.5 centimeters and up to 25.5 centimeters.

In some embodiments, the back plate has a width that varies from the width of the outer wall by up to 1 centimeter. In some specific embodiments, the back plate has a width that varies from the width of the outer wall by up to 5 millimeters. In some very specific embodiments, the back plate has a width that varies from the width of the outer wall by up to 2 millimeters.

In some embodiments, the inner wall has a top surface, bottom surface, right surface, and left surface; the height of the inner wall is measured parallel to the right surface and/or the left surface of the inner wall and perpendicular to the top surface and the bottom surface of the inner wall; the width of the inner wall is measured parallel to the top surface and/or the bottom surface of the inner wall, perpendicular to the right surface and the left surface of the inner wall, and perpendicular to the height of the inner wall; and the depth of the inner wall is measured parallel to the right surface, the left surface, the top surface, and/or the bottom surface of the inner wall and perpendicular to the height and the width of the inner wall.

In some embodiments, the outer wall has a top surface, bottom surface, right surface, and left surface; the height of the outer wall is measured parallel to the right surface and/or the left surface of the outer wall and perpendicular to the top surface and the bottom surface of the outer wall; the width of the outer wall is measured parallel to the top surface and/or the bottom surface of the outer wall, perpendicular to the right surface and the left surface of the outer wall, and perpendicular to the height of the outer wall; and the depth of the outer wall is measured parallel to the right surface, the left surface, the top surface, and/or the bottom surface of the outer wall and perpendicular to the height and the width of the outer wall.

In some embodiments, the top surface of the inner wall, the top surface of the outer wall, the bottom surface of the inner wall, and the bottom surface of the outer wall are approximately parallel to each other.

In some embodiments, the right surface of the inner wall, the right surface of the outer wall, the left surface of the inner wall, and the left surface of the outer wall are approximately parallel to each other.

In some embodiments, the distance between the top surface of the inner wall and the top surface of the outer wall is at least 5 centimeters. In some specific embodiments, the distance between the top surface of the inner wall and the top surface of the outer wall is at least 5 centimeters and up to 8 centimeters. In some very specific embodiments, the distance between the top surface of the inner wall and the top surface of the outer wall is at least 5.5 centimeters and up to 6.5 centimeters.

In some embodiments, the distance between the bottom surface of the inner wall and the bottom surface of the outer wall is at least 5 centimeters. In some specific embodiments, the distance between the bottom surface of the inner wall and the bottom surface of the outer wall is at least 5 centimeters and up to 8 centimeters. In some very specific embodiments, the distance between the bottom surface of the inner wall and the bottom surface of the outer wall is at least 5.5 centimeters and up to 6.5 centimeters.

In some embodiments, (1) the distance between the top surface of the inner wall and the top surface of the outer wall and (2) the distance between the bottom surface of the inner wall and the bottom surface of the outer wall vary by up to 1 centimeter. In some specific embodiments, (1) the distance between the top surface of the inner wall and the top surface of the outer wall and (2) the distance between the bottom surface of the inner wall and the bottom surface of the outer wall vary by up to 5 millimeters. In some very specific embodiments, (1) the distance between the top surface of the inner wall and the top surface of the outer wall and (2) the distance between the bottom surface of the inner wall and the bottom surface of the outer wall vary by no greater than 2 millimeters.

In some embodiments, the distance between the left surface of the inner wall and the left surface of the outer wall is at least 5 centimeters. In some specific embodiments, the distance between the left surface of the inner wall and the left surface of the outer wall is at least 5 centimeters and up to 8 centimeters. In some very specific embodiments, the distance between the left surface of the inner wall and the left surface of the outer wall is at least 5.5 centimeters and up to 6.5 centimeters.

In some embodiments, the distance between the right surface of the inner wall and the right surface of the outer wall is at least 5 centimeters. In some specific embodiments, the distance between the right surface of the inner wall and the right surface of the outer wall is at least 5 centimeters and up to 8 centimeters. In some very specific embodiments, the distance between the right surface of the inner wall and the right surface of the outer wall is at least 5.5 centimeters and up to 6.5 centimeters.

In some embodiments, (1) the distance between the left surface of the inner wall and the left surface of the outer wall and (2) the distance between the right surface of the inner wall and the right surface of the outer wall vary by up to 1 centimeter. In some specific embodiments, (1) the distance between the left surface of the inner wall and the left surface of the outer wall and (2) the distance between the right surface of the inner wall and the right surface of the outer wall vary by up to 5 millimeters. In some very specific embodiments, (1) the distance between the left surface of the inner wall and the left surface of the outer wall and (2) the distance between the right surface of the inner wall and the right surface of the outer wall vary by no greater than 2 millimeters.

In some embodiments, (1) the distance between the top surface of the inner wall and the top surface of the outer wall, (2) the distance between the bottom surface of the inner wall and the bottom surface of the outer wall, (3) the distance between the left surface of the inner wall and the left surface of the outer wall, and (4) the distance between the right surface of the inner wall and the right surface of the outer wall vary by up to 1 centimeter. In some specific embodiments, (1) the distance between the top surface of the inner wall and the top surface of the outer wall, (2) the distance between the bottom surface of the inner wall and the bottom surface of the outer wall, (3) the distance between the left surface of the inner wall and the left surface of the outer wall, and (4) the distance between the right surface of the inner wall and the right surface of the outer wall vary by up to 5 millimeters. In some very specific embodiments, (1) the distance between the top surface of the inner wall and the top surface of the outer wall, (2) the distance between the bottom surface of the inner wall and the bottom surface of the outer wall, (3) the distance between the left surface of the inner wall and the left surface of the outer wall, and (4) the distance between the right surface of the inner wall and the right surface of the outer wall vary by no greater than 2 millimeters.

In some embodiments, the inner wall is approximately centered relative to the outer wall. In some specific embodiments, the inner wall is approximately centered relative to the outer wall such that (1) the distance between the top surface of the inner wall and the top surface of the outer wall is approximately the same as (2) the distance between the bottom surface of the inner wall and the bottom surface of the outer wall and/or such that (3) the distance between the left surface of the inner wall and the left surface of the outer wall is approximately the same as (4) the distance between the right surface of the inner wall and the right surface of the outer wall. In some very specific embodiments, the inner wall is approximately centered relative to the outer wall such that (1) the distance between the top surface of the inner wall and the top surface of the outer wall is approximately the same as (2) the distance between the bottom surface of the inner wall and the bottom surface of the outer wall and such that (3) the distance between the left surface of the inner wall and the left surface of the outer wall is approximately the same as (4) the distance between the right surface of the inner wall and the right surface of the outer wall.

In some embodiments, (1) the distance between the top surface of the inner wall and the top surface of the outer wall, (2) the distance between the bottom surface of the inner wall and the bottom surface of the outer wall, (3) the distance between the left surface of the inner wall and the left surface of the outer wall, and (4) the distance between the right surface of the inner wall and the right surface of the outer wall are each approximately the same.

In some embodiments, the top surface of the inner wall, the top surface of the outer wall, the bottom surface of the inner wall, the bottom surface of the outer wall, the right surface of the inner wall, the right surface of the outer wall, the left surface of the inner wall, and/or the left surface of the outer wall are each approximately perpendicular to the back plate.

In some embodiments, when the lid cover fully engages the outer wall, then the lid cover, the front plate, and the back plate are approximately parallel.

In some embodiments, when the removable back insert fully engages the inner wall, then the removable back insert, the front plate, and the back plate are approximately parallel.

What is claimed is:

1. A frame, comprising a front plate, an inner wall, an outer wall, a back plate, a lid cover, a removable back insert, and flowers, wherein:

the front plate is transparent and mounted to the inner wall;

the removable back insert slidably engages the inner wall in a first direction, wherein, when the removable back insert fully engages the inner wall, then the removable back insert, the inner wall, and the front plate define a two-dimensional space in the frame between the removable back insert and the front plate and between sides of the inner wall;

the inner wall, the outer wall, and the flowers are mounted to the back plate;

the lid cover slidably engages the outer wall in a second direction, wherein, when the lid cover fully engages the outer wall, then (a) the lid cover, the outer wall, the inner wall, the front plate, and the back plate define a three-dimensional space in the frame between the lid cover and the back plate, between the outer wall and the inner wall, and between the lid cover and the front plate, (b) the flowers extend from the outer wall into the three-dimensional space, and (c) the lid cover protects the flowers;

the lid cover and the outer wall are transparent such that the flowers are visible through the lid cover and the outer wall;

the first direction is perpendicular to the front plate and the second direction;

the second direction is parallel to the front plate;

one or both of the removable back insert and the inner wall comprise magnetic fasteners, wherein the magnetic fasteners removably couple the removable back insert to the inner wall when the removable back insert fully engages the inner wall;

the removable back insert comprises a handle configured to remove the removable back insert from the inner wall and thereby decouple the magnetic fasteners; and the back plate comprises an opening that is sized to allow removal of the removable back insert from the inner wall through the opening.

2. A method of using the frame of claim 1, comprising removing the lid cover.

3. The method of claim 2, comprising photographing or videotaping the frame after removing the lid cover, wherein removing the lid cover prevents the photographing or videotaping from recording reflections of the lid cover.

4. A frame, comprising a front plate, an inner wall, an outer wall, a back plate, a lid cover, and a removable back insert, wherein:

the front plate is transparent and mounted to the inner wall;

the inner wall and the outer wall are mounted to the back plate;

the lid cover is transparent and slidably engages the outer wall in a first direction, wherein, when the lid cover fully engages the outer wall, then (a) the lid cover, the outer wall, the inner wall, and the back plate define a three-dimensional space in the frame between the lid cover and the back plate and between the outer wall and the inner wall and (b) the lid cover inhibits fluid communication between the three-dimensional space and air that surrounds the frame;

the removable back insert slidably engages the inner wall in a second direction, wherein, when the removable back insert fully engages the inner wall, then the removable back insert, the inner wall, and the front plate define a two-dimensional space in the frame between the removable back insert and the front plate and between sides of the inner wall;

the first direction is parallel to the front plate and perpendicular to the second direction;

the second direction is perpendicular to the front plate and through the inner wall;

one or both of the removable back insert and the inner wall comprise fasteners, wherein the fasteners removably couple the removable back insert to the inner wall when the removable back insert fully engages the inner wall;

the removable back insert comprises a handle configured to remove the removable back insert from the inner wall and thereby decouple the fasteners; and the back plate comprises an opening that is sized to allow removal of the removable back insert from the inner wall through the opening.

5. The frame as claimed in claim 4, comprising rose flowers, wherein each rose flower is mounted to the back plate and positioned in the three-dimensional space such that each rose flower faces the lid cover and each rose flower is visible through the lid cover.

6. The frame as claimed in claim 4, wherein the outer wall is transparent.

7. The frame as claimed in claim 4, wherein the fasteners are magnetic fasteners.

8. The frame as claimed in claim 4, comprising rose flowers, wherein:

the lid cover fully engages the outer wall;

each rose flower is mounted to the back plate and positioned in the three-dimensional space such that each rose flower faces the lid cover and each rose flower is visible through the lid cover;

the outer wall is transparent such that sides of the rose flowers are visible through the outer wall;

the three-dimensional space has a depth measured between the lid cover and the back plate;

the inner wall has a depth measured between the front plate and the back plate;

the depth of the inner wall is at least 30 percent and up to 90 percent of the depth of the three-dimensional space such that the front plate is suspended in the three-dimensional space;

the three-dimensional space comprises a gap between the front plate and the lid cover;

the front plate defines a plane that intersects the outer wall;

the outer wall, the lid cover, and the plane define a rectangular cuboid space between the lid cover and the plane and between sides of the outer wall;

the rectangular cuboid space comprises the gap;

the three-dimensional space comprises the rectangular cuboid space; and the rose flowers extend into the rectangular cuboid space.

9. The frame as claimed in claim 8, wherein petals of the rose flowers extend into the gap.

10. The frame of claim 4, wherein the frame is effective at protecting flowers within the three-dimensional space during shipping, storage, and handling of the frame.

11. The frame of claim 4, wherein the lid cover hermetically seals the three-dimensional space when the lid cover fully engages the outer wall.

12. The frame as claimed in claim 4, wherein:

when the lid cover fully engages the outer wall, then the three-dimensional space has a depth measured between the lid cover and the back plate;

the inner wall has a depth measured between the front plate and the back plate; and the depth of the inner wall is at least 30 percent and up to 90 percent of the depth of the three-dimensional space such that the front plate is suspended in the three-dimensional space.

13. The frame as claimed in claim 12, wherein:

the front plate defines a plane that intersects the outer wall;

the outer wall, the lid cover, and the plane define a rectangular cuboid space between the lid cover and the plane and between sides of the outer wall; and the three-dimensional space comprises the rectangular cuboid space.

14. The frame as claimed in claim 12, wherein:

the two-dimensional space has a thickness measured between the front plate and the removable back insert, which thickness is no greater than 5 millimeters;

the depth of the inner wall is at least 5 times greater than the thickness of the two-dimensional space and at least 2 centimeters; and the depth of the three-dimensional space is at least 10 times greater than the thickness of the two-dimensional space and at least 4 centimeters.

15. The frame as claimed in claim 4, comprising 18 rose flowers, wherein:

the lid cover fully engages the outer wall;

the 18 rose flowers are arranged in the three-dimensional space in a 5-rose-flower by 6-rose-flower rectangle;

each rose flower is mounted to the back plate and positioned in the three-dimensional space such that each rose flower faces the lid cover and each rose flower is visible through the lid cover;

the outer wall is transparent such that sides of the rose flowers are visible through the outer wall;

the fasteners are magnetic fasteners;

the three-dimensional space has a depth measured between the lid cover and the back plate;

the inner wall has a depth measured between the front plate and the back plate;

the depth of the inner wall is at least 30 percent and up to 90 percent of the depth of the three-dimensional space such that the front plate is suspended in the three-dimensional space;

the three-dimensional space comprises a gap between the front plate and the lid cover; and petals of the rose flowers extend into the gap.

16. The frame as claimed in claim 4, wherein:

the fasteners are magnetic fasteners;

the magnetic fasteners comprise four magnets;

the inner wall comprises two of the four magnets;

the removable back insert comprises two of the four magnets; and the two magnets of the inner wall approximately align with the two magnets of the removable back insert when the removable back insert fully engages the inner wall to apply force between the front plate and the removable back insert.

17. The frame as claimed in claim 4, wherein the inner wall has a height, width, and depth;

the outer wall has a height, width, and depth;

the height of the outer wall is greater than the height of the inner wall;

the width of the outer wall is greater than the width of the inner wall;

the height of the inner wall is at least 16 centimeters and up to than 21 centimeters;

the width of the inner wall is at least 12 centimeters and up to than 15 centimeters;

the depth of the inner wall is at least 3 centimeters and up to than 4 centimeters;

the height of the outer wall is at least 27 centimeters and up to than 34 centimeters;

the width of the outer wall is at least 22 centimeters and up to than 28 centimeters;

the depth of the outer wall is at least 5 centimeters and up to than 9 centimeters;

the back plate has a height of at least 27 centimeters and up to than 34 centimeters;

the back plate has a width of at least 22 centimeters and up to than 28 centimeters;

the inner wall has a top surface, bottom surface, right surface, and left surface;

the outer wall has a top surface, bottom surface, right surface, and left surface;

the height of the inner wall is measured parallel to the right surface or the left surface of the inner wall and perpendicular to the top surface and the bottom surface of the inner wall;

the width of the inner wall is measured parallel to the top surface or the bottom surface of the inner wall, perpendicular to the right surface and the left surface of the inner wall, and perpendicular to the height of the inner wall;

the depth of the inner wall is measured parallel to the right surface, the left surface, the top surface, or the bottom surface of the inner wall and perpendicular to the height and the width of the inner wall;

the height of the outer wall is measured parallel to the right surface or the left surface of the outer wall and perpendicular to the top surface and the bottom surface of the outer wall;

the width of the outer wall is measured parallel to the top surface or the bottom surface of the outer wall, perpendicular to the right surface and the left surface of the outer wall, and perpendicular to the height of the outer wall;

the depth of the outer wall is measured parallel to the right surface, the left surface, the top surface, or the bottom surface of the outer wall and perpendicular to the height and the width of the outer wall;

the top surface of the inner wall, the top surface of the outer wall, the bottom surface of the inner wall, and the bottom surface of the outer wall are approximately parallel to each other;

the right surface of the inner wall, the right surface of the outer wall, the left surface of the inner wall, and the left surface of the outer wall are approximately parallel to each other;

the distance between the top surface of the inner wall and the top surface of the outer wall is at least 5 centimeters and up to 8 centimeters;

the distance between the bottom surface of the inner wall and the bottom surface of the outer wall is at least 5 centimeters and up to 8 centimeters;

the distance between the left surface of the inner wall and the left surface of the outer wall is at least 5 centimeters and up to 8 centimeters;

the distance between the right surface of the inner wall and the right surface of the outer wall is at least 5 centimeters and up to 8 centimeters;

the inner wall is approximately centered relative to the outer wall such that the distance between the top surface of the inner wall and the top surface of the outer wall is approximately the same as the distance between the bottom surface of the inner wall and the bottom surface of the outer wall and such that the distance between the left surface of the inner wall and the left surface of the outer wall is approximately the same as the distance between the right surface of the inner wall and the right surface of the outer wall;

the distance between the top surface of the inner wall and the top surface of the outer wall, the distance between the bottom surface of the inner wall and the bottom surface of the outer wall, the distance between the left surface of the inner wall and the left surface of the outer wall, and the distance between the right surface of the inner wall and the right surface of the outer wall are each approximately the same;

the top surface of the inner wall, the top surface of the outer wall, the bottom surface of the inner wall, the bottom surface of the outer wall, the right surface of the inner wall, the right surface of the outer wall, the left surface of the inner wall, and the left surface of the outer wall are each approximately perpendicular to the back plate;

when the lid cover fully engages the outer wall, then the lid cover, the front plate, and the back plate are approximately parallel; and when the removable back insert fully engages the inner wall, then the removable back insert, the front plate, and the back plate are approximately parallel.

* * * * *